United States Patent [19]

Church

[11] Patent Number: 4,569,490

[45] Date of Patent: Feb. 11, 1986

[54] COUNTERBALANCE MECHANISM

[75] Inventor: William F. Church, Burlington, Wis.

[73] Assignee: Barnes Group, Inc., Bristol, Conn.

[21] Appl. No.: 641,249

[22] Filed: Aug. 16, 1984

Related U.S. Application Data

[63] Continuation-in-part of Ser. No. 594,227, Mar. 28, 1984.

[51] Int. Cl.[4] ..... B65H 75/48

[52] U.S. Cl. ..... 242/107; 16/198; 242/107.5

[58] Field of Search ..... 242/107, 107.1–107.15, 242/107.5; 16/195, 197, 198, 201; 182/231, 232

[56] References Cited

U.S. PATENT DOCUMENTS

| | | | |
|---|---|---|---|
| 526,945 | 10/1894 | Sauerburger | 16/198 |
| 820,962 | 5/1906 | Erb | 16/198 |
| 826,516 | 7/1906 | Law | 16/198 |
| 1,138,738 | 5/1915 | Earll | 185/45 |
| 1,226,843 | 5/1917 | Arvine | 16/197 |
| 1,414,698 | 5/1922 | Karasiewicz | 16/197 |
| 1,669,990 | 5/1928 | Mantz | 16/198 |
| 1,898,584 | 2/1933 | Mantz | 16/198 |
| 2,117,896 | 5/1938 | Mantz | 16/198 |
| 2,190,098 | 2/1940 | Dautrick | 16/198 |
| 2,609,193 | 9/1952 | Foster | 267/156 |
| 2,679,659 | 6/1954 | Grupp | 16/198 |
| 2,718,282 | 9/1955 | Davis | 185/39 |
| 2,767,426 | 10/1956 | Grupp | 16/198 |
| 2,782,456 | 2/1957 | Kenyon | 16/198 |
| 2,797,435 | 7/1957 | Decker et al. | 16/198 |
| 2,833,027 | 5/1958 | Foster | 242/107 X |
| 3,033,488 | 5/1962 | Weber | 242/107.5 |
| 3,146,488 | 9/1964 | Dahlstrom | 16/198 |
| 3,335,455 | 10/1967 | Anderson | 16/198 |
| 3,689,004 | 9/1972 | Brown et al. | 242/107 |
| 3,716,201 | 2/1973 | West | 242/107 |
| 4,088,280 | 5/1978 | Arlauskas et al. | 242/107 |
| 4,159,809 | 7/1979 | Rawson | 242/107 |
| 4,340,190 | 7/1982 | Zavatkay | 242/107 |
| 4,340,191 | 7/1982 | Zavatkay | 242/107 |

FOREIGN PATENT DOCUMENTS

| | | | |
|---|---|---|---|
| 1403616 | 8/1975 | United Kingdom | 242/107 |

*Primary Examiner*—John M. Jillions

*Attorney, Agent, or Firm*—Pennie & Edmonds

[57] ABSTRACT

A spring counterbalance mechanism suitable for counterbalancing window sashes or the like. In one embodiment of the invention, the device has two rotatable drums and a spring disposed within the drums. The spring is connected to a spring arbor on one drum and connected to the interior of the other drum to generate counterbalancing forces for resisting rotation of the two drums. Two rotatable reels are coupled to the drums by peripheral gear teeth on the drums and the reels, and cords are wound on the reels for transmitting the forces to loads. The hubs of the reels on which the cords are wound are substantially smaller than the drums. A clutch mechanism is provided for selectively decoupling the spring arbor from the drums, to permit presetting the spring tension by rotating the arbor without rotation of the drums. In an alternate embodiment, stronger and more uniform forces are obtained by providing two pairs of drums and two springs. The second pair of drums is coupled to the first pair by gear teeth, and the cords are wound on the second pair.

30 Claims, 6 Drawing Figures

COUNTERBALANCE MECHANISM

CROSS-REFERENCE TO RELATED APPLICATION

This is a continuation-in-part of U.S. Patent Application Ser. No. 06/594,227, filed Mar. 28, 1984. cl BACK-

BACKGROUND OF THE INVENTION

1. Field of the Invention

This invention relates to spring counterbalance mechanisms suitable for counterbalancing window sashes or the like. The invention relates more particularly to a counterbalance having at least two rotatable drums, spring means within the drums and connected to the drums to generate counterbalancing forces, at least two rotatable reels respectively coupled to the drums by gear teeth on corresponding exterior flanges on the drums and reels, and means for connecting cords to the reels for transmitting the forces to a point of application.

2. Description of Related Art

An example of a prior device is shown in commonly assigned U.S. Patent Application Ser. No. 06/558,174 of Robert J. Zavatkay, filed Dec. 5, 1983, the disclosure of which is incorporated herein by reference. That application discloses a counterbalance mechanism having at least two rotatable cylindrical drums, each having a cord-receiving exterior surface and an interior space surrounded by substantially all of the exterior surface. Backwound prestressed power springs occupy the interior spaces and are connected to the drums to generate counterbalancing forces, which are transmitted by cords wound on the drums. In one embodiment, a first drum and a central arbor integral with a second drum define an annular spring-receiving space. The second drum is radially outward of part of the first drum, and the spring is attached to the arbor and to the interior periphery of the first drum. In a second embodiment, two of the preceding type of assembly are employed in tandem, with a cord being connected to each drum of the first assembly and wound around the corresponding drum of the second assembly for transmitting a force generated by both of the springs.

The device of the '174 application provides a counterbalancing force substantially greater than that of prior devices, while occupying approximately the same space. The dimensional relationships of the springs and the drums provide for enhanced spring power in minimal space.

SUMMARY OF THE INVENTION

An object of the invention herein is to further improve on the efficiency of the generation of torque for a given volume of space and for a given size spring.

It is a further object to provide a convenient means of presetting the tension on the spring.

According to an aspect of the invention, there is provided a counterbalance mechanism including housing means; two drums independently mounted for rotation in the housing means; each of the drums having an exterior surface; and a spring-receiving interior space radially inward of the exterior surface; a spring occupying the two interior spaces and connected to the drums so as to generate a counterbalancing force resisting rotation of the drums relative to the housing means; two reels independently mounted for rotation in the housing means; each of the reels having a cord-receiving hub; and means for linking the reel to a respective one of the drums for rotation therewith, whereby the counterbalancing force is transmitted from the drums to the two reels; and means for connecting cords to the hubs for transmitting the counterbalancing force to counterbalance an object. According to further features, the cord-receiving hubs are substantially smaller in diameter than the drums; and the reels have substantially the same diameter as the drums. An additional aspect is that a gear wheel is formed on each reel engaging a respective gear wheel on each of the drums, whereby the counterbalancing force is transmitted from the drums to the reels. In a further feature, a central arbor within the drums is coupled to the second drum for rotation therewith, the arbor and the interior surface of the first drum defining a spring-receiving interior space. Also, means are provided for selectively decoupling the arbor from the second drum so as to permit changing the counterbalancing force by rotating the arbor without rotation of the second drum. In another embodiment, a second spring is mounted within cord-receiving means for generating additional counterbalancing forces.

The above, and other objects, features, and advantages of the invention will be apparent from the following detailed description of an illustrative embodiment, with reference to the accompanying drawings.

DETAILED DESCRIPTION OF PREFERRED EMBODIMENTS OF THE INVENTION

Figure 1:
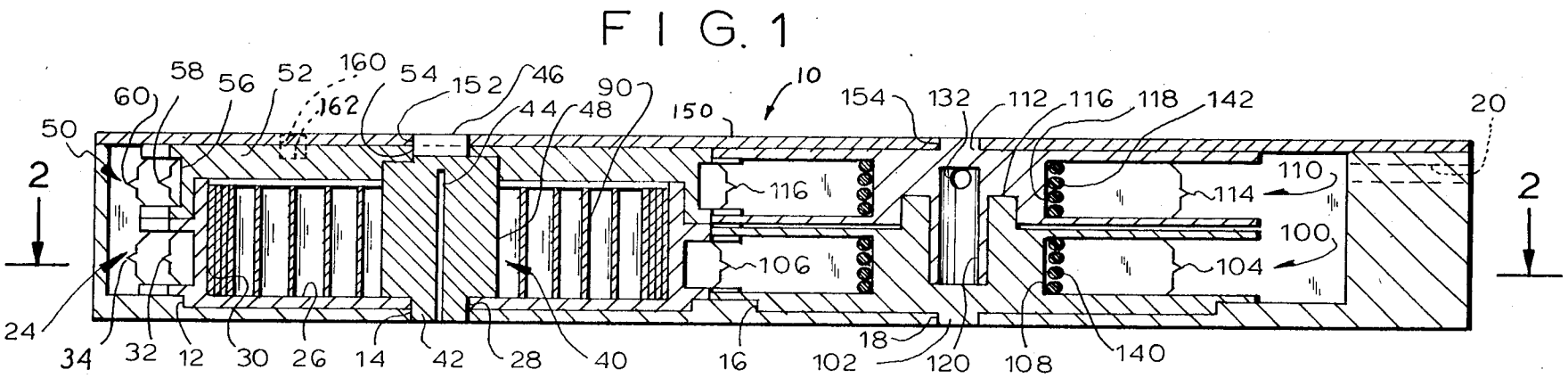
FIG. 1 is a cross-sectional view of a counterbalance mechanism according to an embodiment of the invention.
Figure 2:
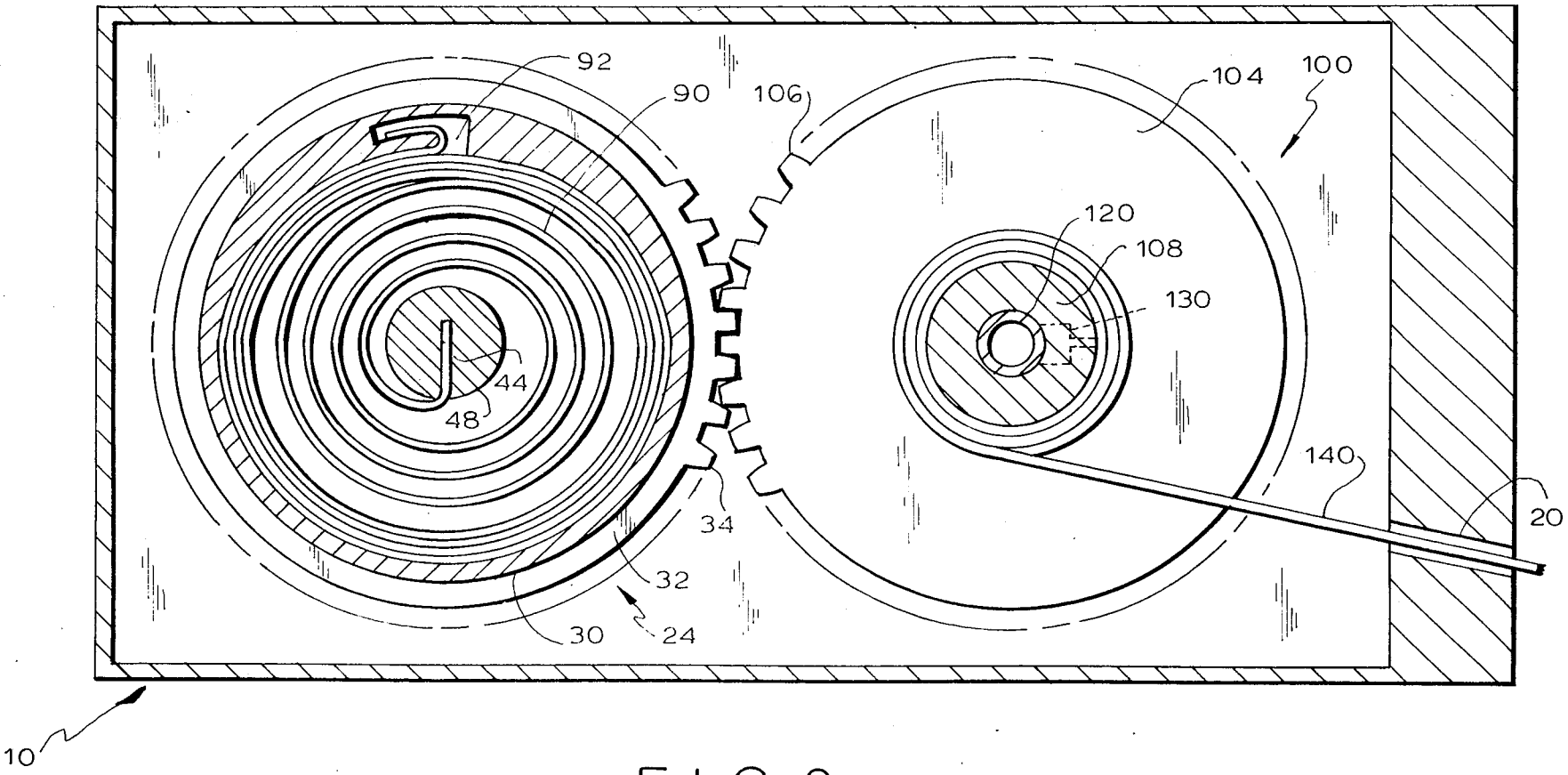
FIG. 2 is a cross-sectional view taken along line 2—2 of FIG. 1.

Referring to FIGS. 1 and 2, there is seen a counterbalance mechanism according to an embodiment of the invention. A plastic or metal case 10 has integrally formed in its floor a circular drum seat 12 having at its center a lower arbor bearing 14 which in this embodiment is a hole through the floor of the case 10. Also formed in the floor of the base 10 is a circular reel seat 16, having at its center a lower reel bearing 18, which in this embodiment is a hole through the floor of the case 10. The case 10 in this embodiment is rectangular, having two integral end walls and two integral side walls extending upward from the floor.

As shown, the end wall of the case nearest the reel seat 16 has an upper cord passage 20 and a lower cord passage 22. The upper cord passage 20 is relatively farther from the floor of the case 10 than is the lower cord passage 22, and the passages are relatively close to the side walls. The longitudinal axes of both cord passages are parallel to the floor of the case 10 and make a 15° angle with the longitudinal axis of the case 10. In the alternative, the case 10 may be made of stamped sheet metal, the cord passages 20 and 22 in that situation being grommeted holes in the end of the case. It may also be desired to locate the cord passages in the floor of the case 10 rather than its end, or elsewhere in the case. If so, conventional radius guides may be provided within the case to change the direction of the cords as necessary.

A cylindrical cup-shaped first drum 24 is disposed with its circular closed lower end 26 in the drum seat 12. At the center of the lower end 26 of the first drum is a hole 28 that extends therethrough, and provides a continuation of the lower arbor bearing 14. The first drum 24 has a cylindrical wall 30 and lower and upper flanges 32 extending radially from the exterior of wall 30 with gear teeth 34 formed in their peripheries.

A cylindrical arbor 40, the main body of which is designated 48, is disposed centrally within the first drum 24. The arbor has a lower cylindrical extension 42 of reduced diameter extending downward in bearing contact with the holes 14 and 28. A longitudinal slot 44 extends from one side of the arbor body 48 and extension 42 into the arbor at least through its longitudinal axis. A narrow central cylindrical upper arbor extension 46 extends from the end of the arbor opposite the lower arbor extension 42. A slot 47 is formed in the upper surface of the extension 46.

A second drum 50 is situated above the first drum 24. The second drum 50 has an upper end 52, which is circular and covers the open upper end of the cup-shaped first drum 24. The upper end 52 has a central hole 54 for accommodating the upper arbor extension 46. Depending from the upper end 52 is a cylindrical wall 56 which closely encloses an upper portion of the wall 30. Radially extending from the lower and upper portions of the wall 56 are flanges 58, the lower of which is closely adjacent to the upper flange 32. Formed in the peripheries of the flanges 58 are gear teeth 60.

Figure 4:
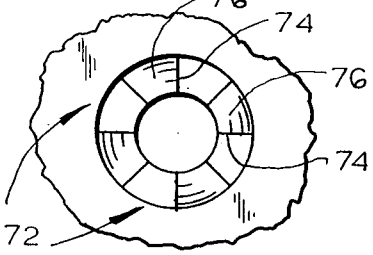
FIG. 4 is a plan view of part of the second drum 50 along line 4—4 of FIG. 3.
Figure 3:
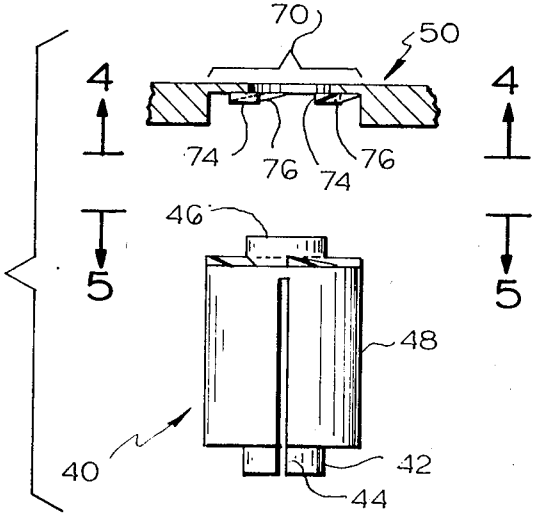
FIG. 3 is an exploded view including an elevation of the arbor 40 and a cross-section of part of the second drum 50 of the embodiment.

As best seen in FIGS. 3 and 4, an arbor seat 70 is centrally located in the underside of the upper end 52 of the second drum 50, the arbor seat being a generally cylindrical space. Depending from the underside of the upper end 52 within the arbor seat 70 is a series of clutch members 72, numbering four in this embodiment, having the form of ramp-like projections each having one vertical side 74 and one sloping side 76. The vertical side 74 drops abruptly from the upper end 52, and the sloping side 76 rises gradually back toward said upper end.

Figure 5:
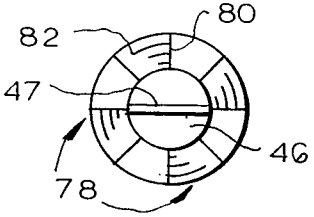
FIG. 5 is a plan view of the arbor 40 along line 5—5 of FIG. 3.

Referring to FIGS. 3 and 5, a series of clutch members 78 are formed in the upper end of the arbor body 48 and surrounding the upper extension 46. The clutch members of the arbor have vertical sides 80 that rise abruptly from the upper end of the arbor body 48 and sloping sides 82 which descend gradually from the vertical sides back to the upper end of the arbor body 48.

The upper end of the arbor body 48 is closely accommodated within the arbor seat 70, so that the members 78 coact with the members 72. The respective clutch members of the arbor seat and the arbor body are oriented so that the vertical sides 80 of the clutch members 78 face in a clockwise direction as viewed from above, while the vertical sides 74 of the clutch members 72 face in a counterclockwise direction as viewed from above. Thus, the two sets of clutch members form a clutch arrangement wherein the arbor and second drum move relatively easily with respect to one another in one direction, but are substantially unable to move in the other direction.

As best seen in FIG. 2 a flat-wound power spring 90 occupies effectively all of the space within the first drum 24, although of course a certain amount of empty space may exist between some turns of the spring. It has been found that the use of a back-wound prestressed power spring, rather than a conventional power spring, optimizes the relationship of spring power to size and weight, because of the enhanced energy storage capacity of such springs. A hook at one end of the spring engages a notch 92 in the interior of the wall 30 of the first drum 24. A hook at the other end of the spring engages the slot 44 in the arbor body 48.

The notch 92, the spring 90, and the arbor 40 are oriented so that rotation of the arbor in a counterclockwise direction, as seen from above, tightens the spring. Conversely, rotation of the first drum 24 in a clockwise direction as seen from above also causes the spring to tighten.

Disposed within the reel seat 16 is a first reel 100. A cylindrical central extension 102 depends therefrom into the lower reel bearing 18. The reel 100 includes a hub 108 and upper and lower side members 104, with gear teeth 106 formed in their peripheries. The first reel 100 has substantially the same diameter as the first drum 24 in this embodiment, and the gear teeth 106 engage the gear teeth 34.

Disposed above the first reel 100 is a second reel 110, which has a central cylindrical upper extension 112, a hub 118, and side members 114 with peripheral gear teeth 116. The gear teeth 116 engage the gear teeth 60 of the second drum 50. Bearing contact between the first reel 100 and the second reel 110 is made by a depending cylindrical central bearing member 120 in the form of a hollow cylinder depending from the center of second reel 110 into the hollow interior of the hub 108. Bearing contact is also provided by a central cylindrical upstanding wall 116 on the upper surface of the central portion of first reel 100, radially outside of the bearing member 120 in an annular groove in the hub 118.

A hole 130 extends between the exterior and the interior of the hub 108, having a wide portion at its interior end and a narrow portion at its exterior end. A hole 132 extends from the exterior to the interior of hub 118.

A first cord 140 is attached to first reel 100 by means of a knotted end in the wider interior end of hole 130 in hub 108. Cord 140 extends through the narrow end of hole 130 and is wound around the exterior of hub 108, and then passes to the exterior of the counterbalance mechanism through hole 22.

A second cord 142 has a knotted end in the interior of hub 118, passes through hole 132, is wound around hub 118, and passes to the exterior of the counterbalance mechanism through hole 20.

The counterbalance mechanism is closed by a cover 150, which has holes 152 and 154 to accommodate elements 46 and 112, respectively. Also extending through the cover is a hole 160, which can be lined up with a corresponding hole 162 in the upper surface of the upper end 52 of the second drum 50. The cover and the other components of the embodiment are made of a suitable plastic material such that at least the cover and the arbor seat 70 are somewhat flexible.

As shown and described, the operation of the above counterbalance mechanism is as follows. Drawing the first cord 140 through the hole 22 causes the first reel 100 to rotate counterclockwise, which in turn causes the first drum 24 to rotate clockwise. This rotation tightens the spring 90, thus resisting extension of the cord 140. Similarly, the spring is tightened by counterclockwise rotation, as seen from above, of the arbor 40. This in turn results from counterclockwise rotation of the second drum 50, due to clockwise rotation of the second reel 110 as the second cord 142 is drawn through the hole 20.

The corresponding clutch members 72 and 78 on the arbor seat 70 and arbor body 48, respectively, provide a convenient means of presetting the tension on the spring 90. A dowel is inserted into the holes 160 and 162 to immobilize the second drum 50. Then a screwdriver or other flat instrument is inserted into the slot 47 in the arbor through the hole 152 and the arbor rotated counterclockwise to provide a desired tension in the spring 92. As the clutch members 78 of the arbor move counterclockwise past the clutch members 72 of the arbor seat 70, the sloping sides 82 and 76 come into contact, and the arbor seat and cover flex slightly to allow them to pass one another. These elements then snap back into place as the vertical sides 74 and 80 come into alignment. Then the screwdriver and dowel are removed. This convenient means of preloading allows for a wide range of window sash weights that can be counterbalanced, and allows for assembly in the field.

The reels in the preceding embodiment are of substantially the same diameter as the corresponding drums. However, the hubs of the reels have a substantially smaller diameter. Thus, the moment arm through which the tension in the first and second cords 140 and 142 act on the reels is relatively small, even when several layers of the cord are built up on the hubs. Therefore, the spring has a relatively high capacity for resisting extension of the cords, i.e., for exerting a counterbalancing force. Also, the range of sash weights that can be counterbalanced is wider because of the smaller moment arm through which the cord tension is required to act.

Even higher forces may be developed by providing another spring and another pair of drums geared to the above-disclosed spring drums. Thus, through only a minimal increase in the occupied space a significantly higher force may be developed. A second embodiment of the invention, which has such characteristics, is shown in FIG. 6.

In the second embodiment, higher and more constant forces are developed by providing two pairs of springs and spring drums. Such a mechanism is particularly useful in installations in which the spring of the first embodiment would be wound nearly fully by the required extension of the cords. When a flat-wound power spring is wound nearly solid, i.e., within one or two turns of being fully tightened, there is a substantial drop-off in the generated torque. This spring characteristic can cause an undesirable hysteresis effect. For example, as a lower window sash is being lowered and the corresponding sash cord extended, a sufficient counterbalancing force may be generated. However, if the spring has been tightened almost fully, sufficient retractive force may not be available at full cord extension for raising the sash back up. If such hysteresis is found in a given installation when using a counterbalance according to the first embodiment, the counterbalance mechanism can be replaced with the second embodiment, which has about the same size, but provides greater and more constant torque at the maximum extension of the cords.

Several factors contribute to these advantageous force characteristics. First, although the moment arm through which the cord tension acts in the second embodiment may be greater than in the first, the second spring provides additional torque to avoid any loss of counterbalancing force. Also, the outer diameters of the drums on which the cords are wound may be greater than the diameters of the reel hubs 108 and 118 in the first embodiment. Therefore, extension of the cords by a given distance in the second embodiment requires fewer turns of the drums than in the first. Because there are two springs, such smaller number of turns is sufficient to produce the counterbalancing force required for a given installation.

Figure 6:
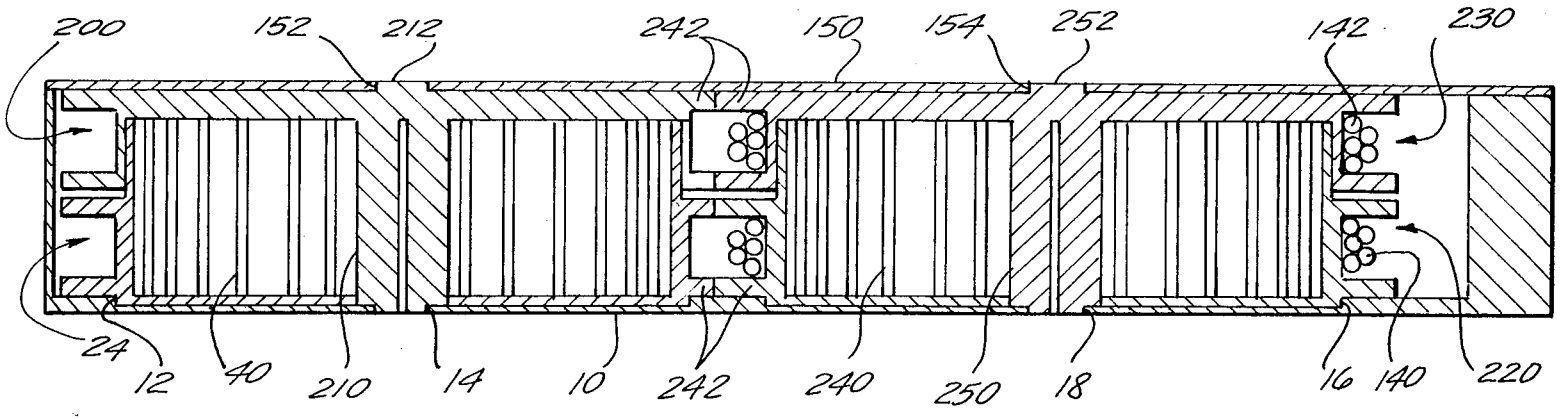
FIG. 6 is a cross-sectional view of a counterbalance mechanism according to a second embodiment of the invention.

The embodiment of FIG. 6 includes a case 10 and a first drum 24 mounted in the case floor in a drum seat 12. A second drum 200 is mounted above the first drum 24 and includes a depending integral arbor 210. The arbor is rotatably mounted in a bearing 14 in the case floor concentric with the drum seat 12. An upper arbor extension 212 above the drum 200 is rotatably mounted in a bearing 152 in the top of the case. A coil spring 90, located within the drums 24 and 200, has one end attached to the arbor 210 and the other to the inner surface of the drum 24.

Also enclosed within case 10 are third and fourth drums 220 and 230, which are similar to the first and second drums 24 and 200, respectively. The third drum 220 is mounted in a drum seat 16 in the case floor. The fourth drum 230 has an integral depending arbor 250 mounted in a bearing 18, and an upper arbor extension 252 rotatably mounted in a bearing 154 in the top of the case. A second coil spring 240, which is located within drums 220 and 230, is attached at one end to drum 220 and at the other to arbor 250.

The four drums 24, 200, 220, 230 each have lower and upper radial flanges with peripheral gear teeth 242. The drums are mounted so that the lower two drums, i.e., the first drum 24 and third drum 220, are interconnected by the gear teeth for mutual rotation. Similarly, the gear teeth 242 also interconnect the upper drums, i.e., the second drum 200 and fourth drum 230.

First and second cords 140 and 142 are attached to and wound around the third and fourth drums 220 and 230, respectively.

In the operation of the second embodiment, when the first cord 140 is unwound by drawing it away from the mechanism, the cord 140 rotates the third drum 220 counterclockwise, as seen from above, which in turn causes first drum 24 to rotate clockwise. Such rotations tighten both spring 90 and spring 240 to resist extension of the cord 140. Drawing the second cord 142 away from the mechanism causes counterclockwise rotation of the arbor 210 and clockwise rotation of the arbor 250, which also tightens both spring 90 and spring 240.

Although illustrative embodiments of the invention have been described herein, the invention is not limited to such embodiments. There is no intention of excluding any equivalents of the features shown and described, or portions thereof, but rather it is recognized that various modifications are possible within the scope of the invention as defined in the following claims.

What is claimed is:

1. A counterbalance mechanism comprising, in combination:

(a) housing means;

(b) first and second drums mounted for rotation in said housing means, each of said drums having (1) an exterior surface;
(2) a spring-receiving interior space radially inward of said exterior surface; and
(3) gear means rotatable with said drum;

(c) third and fourth drums mounted for rotation in said housing means, each of said drums having
(1) a cord-receiving exterior surface;
(2) a spring-receiving interior space radially inward of said exterior surface; and
(3) gear means rotatable with said drum and engaging respective gear means rotatable with one of said first and second drums;

(d) spring means in said interior spaces of said four drums and connected to said drums so as to generate a counterbalancing force resisting rotation of said drums relative to said housing means; and (e) means for connecting cords to said third and fourth drums for transmitting said counterbalancing force to counterbalance an object.

2. A counterbalance mechanism as in claim 1, in which said spring means includes at least two backwound prestressed flat springs.

3. A counterbalance mechanism as in claim 1, in which said exterior surfaces of said four drums are substantially equal in diameter.

4. A counterbalance mechanism as in claim 1, in which said spring means substantially fully occupy said interior spaces of said drums.

5. A counterbalance mechanism as in claim 1, in which each of said gear means rotatable with said drums includes at least one gear wheel on said exterior surface of said drum.

6. A counterbalance mechanism as in claim 3, in which said gear wheels are substantially equal in diameter.

7. A counterbalance mechanism as in claim 1, in which said drums are mounted for independent rotation in said housing means.

8. A counterbalance mechanism comprising, in combination:

housing means;

a first pair of concentric drums mounted for rotation in said housing means, each of said drums having an exterior surface and gear means rotatable with said drum, and said drums together defining a first spring-receiving interior space radially inward of said two exterior surfaces;

a second pair of concentric drums mounted for rotation in said housing means, each of said drums having a cord-receiving exterior surface and gear means rotatable with said drum, each of said gear means of said second pair of drums engaging the gear means of a respective one of said first pair of drums, said second pair of drums together defining a second spring-receiving interior space radially inward of said two exterior surfaces thereof;

spring means in said first and second interior spaces and connected to said drums so as to generate a counterbalancing force resisting rotation of said drums relative to said housing means; and means for connecting cords to said second pair of drums for transmitting said counterbalancing force to counterbalance an object.

9. A counterbalance mechanism as in claim 8, in which said spring means includes at least two backwound prestressed flat springs.

10. A counterbalance mechanism as in claim 8, in which said spring-receiving interior spaces are radially inward of substantially all of said exterior surfaces.

11. A counterbalance mechanism as in claim 10, in which spring means substantially fully occupy said interior spaces of said drums.

12. A counterbalance mechanism as in claim 8, in which each of said gear means rotatable with said drums includes at least one gear wheel on said exterior surface of said drum.

13. A counterbalance mechanism as in claim 8, in which said drums are mounted for independent rotation in said housing means.

14. A counterbalance mechanism comprising (a) housing means;

(b) first and second drums mounted for rotation in said housing means, each of said drums having
(1) an exterior surface;
(2) a spring-receiving interior space radially inward of said exterior surface; and
(3) gear means rotatable with said drum;

(c) third and fourth drums mounted for rotation in said housing means, each of said drums having
(1) a cord-receiving exterior surface;
(2) a spring-receiving interior space radially inward of said exterior surface; and
(3) gear means rotatable with said drum and engaging respective gear means rotatable with one of said first and second drums;

(d) spring means in said interior spaces of said four drums and connected to said drums so as to generate counterbalancing forces resisting rotation of said first and second drums relative to one another, and resisting rotation of said third and fourth drums relative to one another; and (e) means for connecting cords to said third and fourth drums for transmitting said counterbalancing forces to counterbalance an object.

15. A counterbalance mechanism as in claim 14, in which each of said gear means rotatable with said drums includes at least one gear wheel on said exterior surface of said drum.

16. A counterbalance mechanism as in claim 14, in which said spring means substantially fully occupy said interior spaces of said drums.

17. A counterbalance mechanism as in claim 16, in which said spring-receiving interior spaces are radially inward of substantially all of said exterior surfaces.

18. A counterbalance mechanism as in claim 17, in which said spring means includes at least one backwound prestressed flat spring.

19. A counterbalance mechanism as in claim 16, in which said spring means includes at least one backwound prestressed flat spring.

20. A counterbalance mechanism comprising housing means;

a first pair of concentric drums mounted for rotation in said housing means, each of said drums having an exterior surface and gear means rotatable with said drum, and said drums together defining a first spring-receiving interior space radially inward of said two exterior surfaces;

a second pair of concentric drums mounted for rotation in said housing means, each of said drums having a cord-receiving exterior surface and gear means rotatable with said drum, each of said gear means of said second pair of drums engaging the gear means of a respective one of said first pair of drums, said second pair of drums together defining a second spring-receiving interior space radially inward of said two exterior surfaces thereof;

spring means in said first and second interior spaces and connected to said drums so as to generate counterbalancing forces resisting rotation of said first pair of drums relative to one another, aad resisting rotation of said second pair of drums relative to one another; and means for connecting cords to said second pair of drums for transmitting said counterbalancing forces to counterbalance an object.

21. A counterbalance mechanism as in claim 20, in which said spring means substantially fully occupy said interior spaces of said drums.

22. A counterbalance mechanism as in claim 21, in which said spring-receiving interior space are radially inward of substantially all of said exterior surfaces.

23. A counterbalance mechanism as in claim 21, in which said-spring means includes at least one back-wound prestressed flat spring.

24. A counterbalance mechanism as in claim 20, in which each of said gear means rotatable with said drums includes at least one gear wheel on said exterior surface of said drum.

25. A counterbalance mechanism as in claim 4, in which said spring means includes at least one back-wound prestressed flat spring.

26. A counterbalance mechanism as in claim 4, in which said spring means includes at least one back-wound prestressed flat spring.

27. A counterbalance mechanism as in claim 26, in which said spring-receiving interior spaces are radially inward of substantially all of said exterior surfaces.

28. A counterbalance mechanism as in claim 11, in which said spring means includes at least one back-wound prestressed flat spring.

29. A counterbalance mechanism comprising (a) housing means;

(b) first and second drums rotatably mounted in said housing means, each of said drums having gear means rotatable with said drum;

(c) first spring means coupled to said first and second drums for generating counterbalancing forces resisting rotation of said first and second drums relative to one another;

(d) third and fourth drums rotatably mounted in said housing means, each of said drums having gear means rotatable with said drum, and each of said gear means of said third and fourth drums engaging the gear means of a respective one of said first and second drums;

(e) second spring means coupled to said third and fourth drums for generating counterbalancing forces resisting rotation of said third and fourth drums relative to one another; and (f) means for connecting cords to said third and fourth drums for transmitting said counterbalancing forces generated by said first and second spring means to counterbalance an object.

30. A counterbalance mechanism as in claim 29, in which each of said gear means rotatable with a respective one of said drums includes at least one gear wheel coupled to said drum for rotation therewith.

* * * * *